US007103541B2

(12) United States Patent
Attias et al.

(10) Patent No.: US 7,103,541 B2
(45) Date of Patent: Sep. 5, 2006

(54) MICROPHONE ARRAY SIGNAL ENHANCEMENT USING MIXTURE MODELS

(75) Inventors: Hagai Attias, Seattle, WA (US); Li Deng, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 933 days.

(21) Appl. No.: 10/183,267

(22) Filed: Jun. 27, 2002

(65) Prior Publication Data

US 2004/0002858 A1 Jan. 1, 2004

(51) Int. Cl.
*G10L 21/02* (2006.01)

(52) U.S. Cl. ..... 704/226; 704/225; 704/233; 704/219; 704/256; 381/94.3; 381/94.2

(58) Field of Classification Search ..... 704/225–228, 704/233, 219, 256; 381/94.3, 94.2, 320; 379/290

See application file for complete search history.

(56) References Cited

U.S. PATENT DOCUMENTS

| | | | | |
|---|---|---|---|---|
| 4,811,404 | A * | 3/1989 | Vilmur et al. | 381/94.3 |
| 5,544,250 | A * | 8/1996 | Urbanski | 381/94.3 |
| 5,550,924 | A * | 8/1996 | Helf et al. | 381/94.3 |
| 5,574,824 | A * | 11/1996 | Slyh et al. | 704/226 |
| 5,864,806 | A * | 1/1999 | Mokbel et al. | 704/234 |
| 5,878,389 | A * | 3/1999 | Hermansky et al. | 704/226 |
| 5,966,689 | A * | 10/1999 | McCree | 704/226 |
| 6,001,131 | A * | 12/1999 | Raman | 704/226 |
| 6,453,327 | B1 | 9/2002 | Nielsen | |
| 6,757,830 | B1 | 6/2004 | Tarbotton et al. | |
| 6,910,011 | B1 * | 6/2005 | Zakarauskas | 704/233 |
| 2002/0199095 | A1 | 12/2002 | Bandini et al. | |

FOREIGN PATENT DOCUMENTS

WO WO 2004/059506 7/2004

OTHER PUBLICATIONS

Lee et al., ("Time-domain approach using multiple Kalman filters and EM algorithm to speech enhancement with nonstationary noise", IEEE Transactions on Speech and Audio Processing, vol. 8, issue 3, May 2000, pp. 282-291).*

Deisher et al., ("Speech enhancement using a state-based transform model", 1194 Conference Record of the Twenty-Eighth Asilomar Conference on Signals, Systems and Computers, vol. 2, Oct. 31-Nov. 2, 1994, pp. 1242-1246).*

Hattias and L. Deng, A new approach to speech enhancement with a microphone array using EM and mixture models. Proceedings of the 7th International Conference on Spoken Language Processing, 2002. 4 pages.

"Statistical-Model-Based Speech Enchancement Systems"; Yariv Ephraim, Proceedings of IEEE, vol. 80, No. 10, Oct. 1992 pp. 1526-1555.

(Continued)

*Primary Examiner*—Vijay Chawan
(74) *Attorney, Agent, or Firm*—Amin & Turocy, LLP

(57) ABSTRACT

A system and method facilitating signal enhancement utilizing mixture models is provided. The invention includes a signal enhancement adaptive system having a speech model, a noise model and a plurality of adaptive filter parameters. The signal enhancement adaptive system employs probabilistic modeling to perform signal enhancement of a plurality of windowed frequency transformed input signals received, for example, for an array of microphones. The signal enhancement adaptive system incorporates information about the statistical structure of speech signals. The signal enhancement adaptive system can be embedded in an overall enhancement system which also includes components of signal windowing and frequency transformation.

21 Claims, 6 Drawing Sheets

OTHER PUBLICATIONS

"A New Method for Speech Denoising and Robus Speech Recognition Using Probabilistic Models for Clean Speech and for Noise"; Hagai Attias, et al.; Microsoft.
"Blind Source Separation and Deconvolution: The Dynamic Component Analysis Algorithm"; H Attias, et al.; University of California at San Francisco; pp. 1-37.
Brendan J. Frey, et al. Algonquin: Iterating Laplace's Method to Remove Multiple Types of Acoustic Distortion for Robust Speech Recognition, Proceedings of the European Conference on Speech Communication and Technology, Sep. 2001, 4 pages.
Scott M. Griebel, et al. Microphone Array Speech Dereverberation Using Coarse Channel Modeling, IEEE 2001, pp. 201-204.
Michael J. Jordan, et al. An Introduction to Variational Methods for Graphical Models, Machine Learning, 37, 1999, pp. 183-233.
Partial European Search Report, EP33823TE900kap, mailed Jun. 21, 2005.

* cited by examiner

MICROPHONE ARRAY SIGNAL ENHANCEMENT USING MIXTURE MODELS

TECHNICAL FIELD

The present invention relates generally to signal enhancement, and more particularly to a system and method facilitating signal enhancement utilizing mixture models.

BACKGROUND OF THE INVENTION

The quality of speech captured by personal computers can be degraded by environmental noise and/or by reverberation (e.g., caused by the sound waves reflecting off walls and other surfaces, especially in a large room). Quasi-stationary noise produced by computer fans and air conditioning can be significantly reduced by spectral subtraction or similar techniques. In contrast, removing non-stationary noise and/or reducing the distortion caused by reverberation can be more difficult. De-reverberation is a difficult blind deconvolution problem due to the broadband nature of speech and the high order of the equivalent impulse response from the speaker's mouth to the microphone.

Signal enhancement can be employed, for example, in the domains of improved human perceptual listening (especially for the hearing impaired), improved human visualization of corrupted images or videos, robust speech recognition, natural user interfaces, and communications. The difficulty of the signal enhancement task depends strongly on environmental conditions. Take an example of speech signal enhancement, when a speaker is close to a microphone and the noise level is low and when reverberation effects are fairly small, standard signal processing techniques often yield satisfactory performance. However, as the distance from the microphone increases, the distortion of the speech signal, resulting from large amounts of noise and significant reverberation, becomes gradually more severe.

Conventional signal enhancement systems have employed signal processing methods, such as spectral subtraction, noise cancellation, and array processing. These methods have had many well known successes; however, they have also fallen far short of offering a satisfactory, robust solution to the general signal enhancement problem. For example, one shortcoming of these conventional methods is that they typically exploit just second order statistics (egg., functions of spectra) of the sensor signals and ignore higher order statistics. In other words, they implicitly make a Gaussian assumption on speech signals that are highly non-Gaussian. A related issue is that these methods typically disregard information on the statistical structure of speech signals. In addition, some of these methods suffer from the lack of a principled framework. This has resulted in ad hoc solutions, for example, spectral subtraction algorithms that recover the speech spectrum of a given frame by essentially subtracting the estimated noise spectrum from the sensor signal spectrum, requiring a special treatment when the result is negative due in part to incorrect estimation of the noise spectrum when it changes rapidly over time. Another example is the difficulty of combining algorithms that remove noise with algorithms that handle reverberation into a single system in a systematic manner.

SUMMARY OF THE INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention provides for an adaptive system for signal enhancement. The system can enhance signals, for example, to improve the quality of speech that is acquired by microphones by reducing reverberation and/or noise. The system employs probabilistic modeling to perform signal enhancement of frequency transformed input signals. The system incorporates information about the statistical structure of speech signal using a speech model, which can be pre-trained on a large dataset of clean speech. The speech model is thus a component of the system that describes the statistical characteristics of the observed sensor signals. The system is parameterized by adaptive filter parameters and a specific noise model (e.g., associated with the spectra of sensor noise). The system can utilize an expectation maximization (EM) algorithm that facilitates estimation (modification) of the adaptive filter parameters and provides an enhanced output signal (e.g., Bayes optimal estimation of the original speech signal). Thus, probabilistic modeling is extended beyond a single sensor utilizing an enhancement algorithm that takes advantage of a microphone array.

The speech model characterizes the statistical properties of clean speech signals (e.g., without noise and/or reverberation effect(s)). The speech model can be a mixture model or a hidden Markov model (HMM). The speech model can be trained offline, for example, on a large dataset of clean speech. The noise model characterizes the statistical properties of noise recorded at the input sensors (e.g., microphones). The noise model can be estimated offline, from quiet moments in the noisy signal (or from separate noisy environments in absence of speech signals). It can also be estimated online using expectation maximization on the full microphone signal (e.g., not just the quiet periods).

The signal enhancement adaptive system combines the speech model with the noise model to create a new model for observed sensor signals. The resulting new, combined model is a hidden variable model, where the original speech signal and speech state are the hidden (unobserved) variables, and the sensor signals are the data (observed) variables. The combined model utilizes the adaptive filter parameters to provide an enhanced signal output (e.g., Bayes optimal estimator of the original speech signal) based on a plurality of frequency-transformed input signals. The adaptive filter parameters are modified based, at least in part, upon the speech model, the noise model and/or the enhanced signal output.

In accordance with an aspect of the present invention, an EM algorithm consisting of a maximization step (or M-step) and an expectation step (or E-step) is employed. The M-step updates the parameters of the noise signals and reverberation filters, and the E-step updates sufficient statistics, which includes the enhanced output signal (e.g., speech signal estimator). In other words, the EM algorithm is employed to estimate the adaptive filter parameters and/or the noise spectra from the observed sensor data via the M-step. The EM algorithm also computes the required sufficient statistics (SS) and the speech signal estimator (e.g., the enhanced signal output) via the E-step.

An iteration in the EM algorithm consists of an E-step and an M-step. For each iteration, the algorithm gradually improves the parameterization until convergence. The EM algorithm may be performed as many EM iterations as necessary (e.g., to substantial convergence). The EM algorithm uses a systematic approximation to compute the SS. The effect of the approximation is to introduce an additional iterative procedure nested within the E-step.

In order to compute the SS, for each frame and subband, the E-step computes (1) the conditional mean and precision of the enhanced signal output, and, (2) the conditional probability of the speech model. Using the mean of the speech signal conditioned on the observed data, the enhanced signal output is also calculated. The autocorrelation of the mean of the enhanced signal output and its cross correlation with the data are also computed. In the M-step, the adaptive filter parameters are modified based on the auto correlation and cross correlation of the enhanced signal output.

Another aspect of the present invention provides for a signal enhancement system having the signal enhancement adaptive component, a windowing component, a frequency-transformation component and/or audio input devices. The windowing component facilitates obtaining subband signals by applying an N-point window to input signals, for example, received from the audio input devices. The frequency-transformation component receives the windowed signal output from the windowing component and computes a frequency transformation (e.g., Fast Fourier Transform) of the windowed signal.

To the accomplishment of the foregoing and related ends, certain illustrative aspects of the invention are described herein in connection with the following description and the annexed drawings. These aspects are indicative, however, of but a few of the various ways in which the principles of the invention may be employed and the present invention is intended to include all such aspects and their equivalents. Other advantages and novel features of the invention may become apparent from the following detailed description of the invention when considered in conjunction with the drawings.

DETAILED DESCRIPTION OF THE INVENTION

Figure 1:
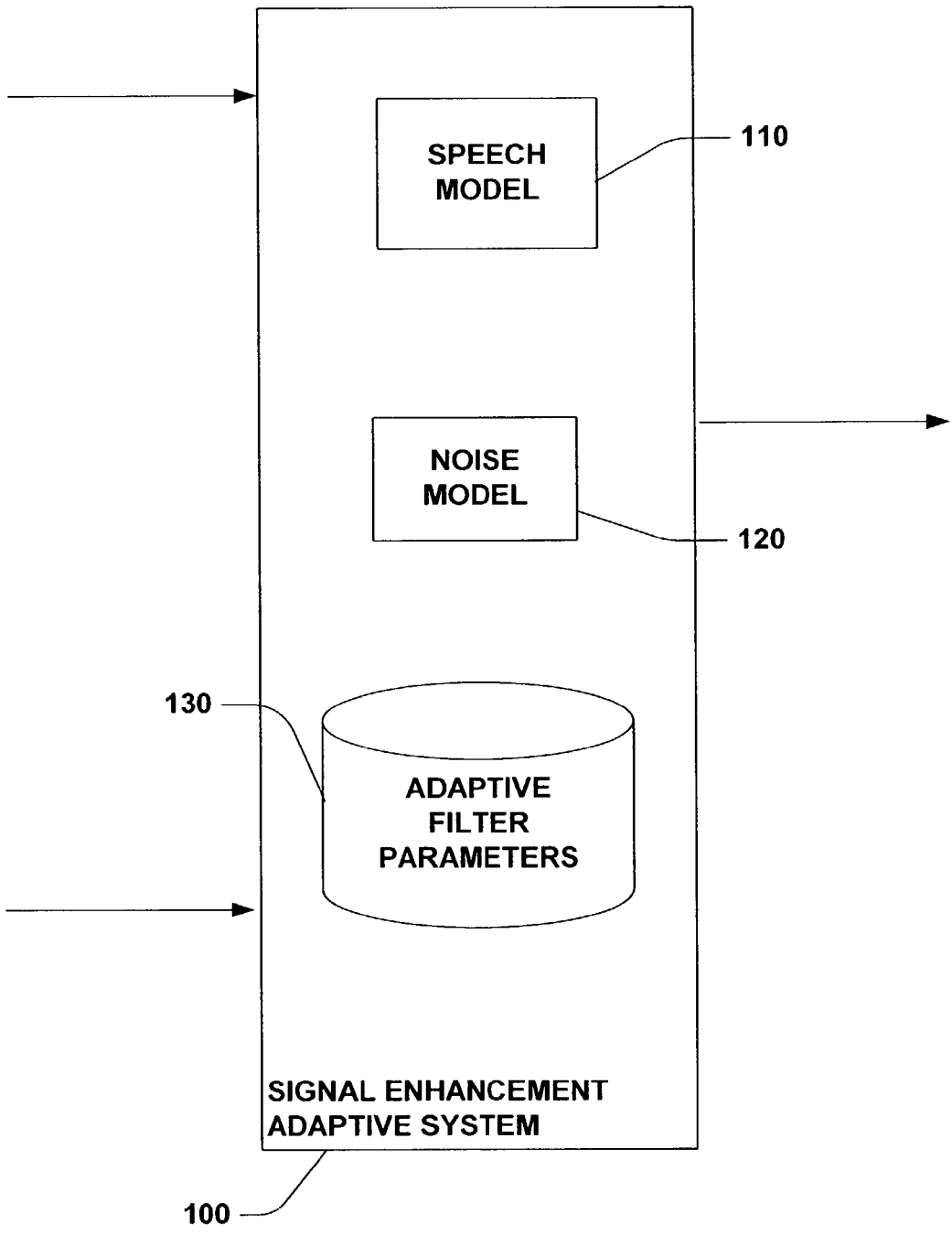
FIG. 1 is a block diagram of a signal enhancement adaptive system in accordance with an aspect of the present invention.

The present invention is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

As used in this application, the term "computer component" is intended to refer to a computer-related entity, either hardware, a combination of hardware and software, software, or software in execution. For example, a computer component may be, but is not limited to being, a process running on a processor, an object, an executable, a thread of execution, a program, and/or a computer. By way of illustration, both an application running on a server and the server can be a computer component. One or more computer components may reside within a process and/or thread of execution and a component may be localized on one computer and/or distributed between two or more computers.

In order to facilitate explanation of the present invention, a discussion of the mathematical description of speech enhancement having a plurality of input sensors (e.g., microphones) is presented. First, let x[n] denote the source signal at time point n, and let $y^i[n]$ denote the signal received at sensor i at the same time. As the source signal propagates toward the sensors, the source signal is distorted by several factors, including the response of the propagation medium and multi-path propagation conditions. The resulting reverberation effects can be modeled by linear filters applied to the source signal. Background noise and sensor noise, which are assumed to be additive, lead to additional distortion. Hence, the signal received at sensor i is:

$$y^i[n] = \sum_m h^i[m]x[n-m] + u^i[n] \tag{1}$$

where $h^i[m]$ denotes the impulse response of the filter corresponding to sensor i, and $u^i[n]$ is the associated noise.

Rather than time domain signals (e.g., x[n]), the present invention will be discussed with regard to subband signals. Subband signals are obtained by applying an N-point window to the signal at substantially equally spaced points and computing a frequency transform of the windowed signal. For purposes of discussion with regard to the present invention, a Fast Fourier Transform (FFT) of the windowed signal will be used; however, it is to be appreciated that any type of frequency transform suitable for carrying out the present invention can be employed and all such types of frequency transforms are intended to fall within the scope of the hereto appended claims.

For the speech signal x[n], $X_m[k]$ denotes the mth subband signal (e.g., frame), defined by $$X_m[k] = \sum_n e^{-iw_k n} w[n]x[mJ+n] \tag{2}$$

where w[n] is the window function, which vanishes outside $n \in \{0, N-1\}$ and J>0 is the spacing between the starting points of the windows, k=(0:N−1) runs over the subbands, and m=(0:M−1) indexes the frames. Assuming that the subband signals satisfy substantially the same relation as the time domain signals set forth in equation (1), the subband signals $Y_m^i[k]$ and $U_m^i[k]$ corresponding to the sensor and noise signals can be shown to satisfy the following approximate relationship:

$$Y'_m[k] \approx \sum_n H_n^i[k] X_{m-n}[k] + U'_m[k] \tag{3}$$

where the complex quantities $H_n^i[k]$ are related to the filters $h^i[m]$ by a linear transformation, the exact form of which is omitted for sake of brevity. While the relation set forth in equation (3) is exact only in the limit $N \to \infty$, for finite N the resulting approximation can be accurate for a suitable choice of the window function.

With regard to probabilistic signal models, the following notation will be employed. For a complex variable Z, a Gaussian distribution with mean μ and precision ν (defined as the inverse variance) are defined by:

$$p(Z) = N(Z|\mu, \nu) = \frac{\nu}{\pi} \exp(-\nu|Z-\mu|^2). \tag{4}$$

Viewed as a joint distribution over Re Z and Im Z, p(Z) integrates to one, and satisfies $E(Z)=\mu$, $E(|Z|^2)=|\mu|^2+1/\nu$. The operator E denotes averaging.

When building statistical models of subband signals, the real valued subbands k=0, N/2 will be ignored and the complex ones will be utilized. The complex (N/2−1)—dim vector $X_m$ containing substantially all subbands of frame m is defined as:

$$X_m=(X_m[1], \ldots, X_m[N/2-1]) \tag{5}$$

(for k>N/2, $X_m[k]=X_m[N=k]^*$). Further, X[k] denotes subband k of all frames, and X denotes all subbands of all frames:

$$X[k]=\{X_m[k], m=(0:M-1)\},$$

$$X=\{X_m[k], k=(0:N-1), m=(0:M-1)\} \tag{6}$$

A corresponding notation is used $Y^i$ and $U^i$. This notation will be utilized to discuss the systems and methods of the present invention.

Referring to FIG. 1, a signal enhancement adaptive system 100 in accordance with an aspect of the present invention is illustrated. The system 100 includes a speech model 110, a noise model 120 and adaptive filter parameters 130.

The system 100 provides a technique that can enhance signals, for example to improve the quality of speech that is acquired by microphones (not shown) by reducing reverberation and/or noise. The system 100 employs probabilistic modeling to perform signal enhancement of a plurality of frequency-transformed input signals. The system 100 incorporates information about the statistical structure of speech signal(s) using the speech model 110, which can be pre-trained on a large dataset of clean speech. The speech model 110 is thus a component of the model 100 that describes observed sensor signals. The system 100 is parameterized by the adaptive filter parameters 130 (e.g., associated with reverberation) and the noise model 120 (e.g., associated with the spectra of sensor noise). The system 100 can utilize an expectation maximization (EM) algorithm that facilitates estimation (modification) of the adaptive filter parameters 130 and provides an enhanced output signal (e.g., Bayes optimal estimation of the original speech signal).

The speech model 110 statistically characterizes clean speech signals (e.g., without noise and/or reverberation effect(s)). For example, the speech model 110 can be a mixture model or a hidden Markov model (HMM). The speech model 110 can be trained offline, for example, on a large dataset of clean speech.

Using the notation set forth above, the speech model 110 S for a signal having speech frames $X_m$ can be described by a C-component Gaussian mixture model. $S_m$ denotes the component label at frame m, which assumes the value s=(1:C) with probability $\pi_s$. Component s has mean zero and precision $A_s$. Therefore, $$p\left(\frac{X_m}{S_m} = s\right) = \prod_{k=1}^{N/2-1} N(X_m[k] \mid 0, A_s[k]) \tag{7}$$

$$p(S_m = s) = \pi_s$$

This Gaussian has a diagonal covariance matrix with $1/A_s[k]$ on the diagonal, leading to the interpretation of the precisions as the inverse spectrum of component s, since $$E(|X_m[k]|^2|S_m=s)=1/A_s[k]. \tag{8}$$

Thus, for $X_m$, the mixture distribution $p(X_m)$ is given by $\Sigma_s p(X_m|S_m=s)\, p(S_m=s)$. It can be noted that whereas different subbands of a given component are independent, subbands of $X_m$ are correlated via the summation over components.

For independently and identically distributed (i.i.d.) frames:

$$p(X \mid S) = \prod_m p(X_m \mid S_m), \quad p(S) = \prod_m p(S_m) \tag{9}$$

where S denotes the labels in all frames collectively, $S=\{S_m, m=(0:M)\}$. Thus, the speech model 110 S is parameterized by $\{A_s, \pi_s\}$.

In one example, the speech model 110 is trained offline on a large speech database including 150 male and female speakers reading sentences from the Wall Street Journal (see H. Attias, L. Deng, A. Acero, J. C. Platt (2001), A new method for speech denoising using probabilistic models for clean speech and for noise, *Proc. Eurospeech* 2001).

Actual speech signal frames are generally not i.i.d. It is to be appreciated that incorporation of speech models, such as HMMs, to describe inter-frame correlations into the framework of the present invention is straightforward and intended to fall within the scope of the hereto appended claims. However, for purposes of simplification, i.i.d. speech signal frames will be assumed unless otherwise noted.

The noise model 120 U models noise recorded at the input sensors (e.g., microphones). For the noise recorded at sensor i, a colored zero-mean Gaussian model with spectrum $1/B^i[k]$, is used:

$$p(U'_m) = \prod_k N(U'_m[k] \mid 0, B'[k]) \tag{10}$$

Equation (10) assumes that the noise signals at different sensors are uncorrelated; however, this assumption can be easily relaxed. Conventional noise cancellation algorithms typically rely on noise correlation between sensors. Using the i.i.d. assumption, the noise model 120 U for a sensor i is given by $p(U_i)=\Pi_m p(U_m^i)$.

The noise model 120 U implies the distribution of the sensor signals conditioned on the original speech signal. Substituting equation (3), $U_m^i[k]=Y_m^i[k]-\Sigma_n H_n^i[k]X_{m-n}[k]$ in equation (10) yields:

$$p(Y'_m \mid X) = \prod_k N\left(Y'_m[k] \,\middle|\, \sum_n H_n^i[k]X_{m-n}[k],\ B'[k]\right) \tag{11}$$

where $X=\{X_m[k]\}$ as defined above. Note that the sensor signal distribution at frame m depends on not only the speech signal at the same frame but also at previous frames. The noise frames being i.i.d. lead to $$p(Y' \mid X) = \prod_m p(Y'_m \mid X) \tag{12}$$

The noise model 120 can be estimated offline, from quiet moments in the noisy signal and/or online using expectation maximization on the full microphone signal (e.g., not just the quiet periods).

The complete data comprise the observed variables $Y=\{Y^i\}$ and the unobserved variables X, S. Using the assumption of sensor independence, the complete data distribution of the system 100 is obtained:

$$p(Y, X, S) = \prod_i p(Y' \mid X)p(X \mid S)p(S) \tag{13}$$

whose factors are specified by equation (9) and equation (12).

Figure 2:
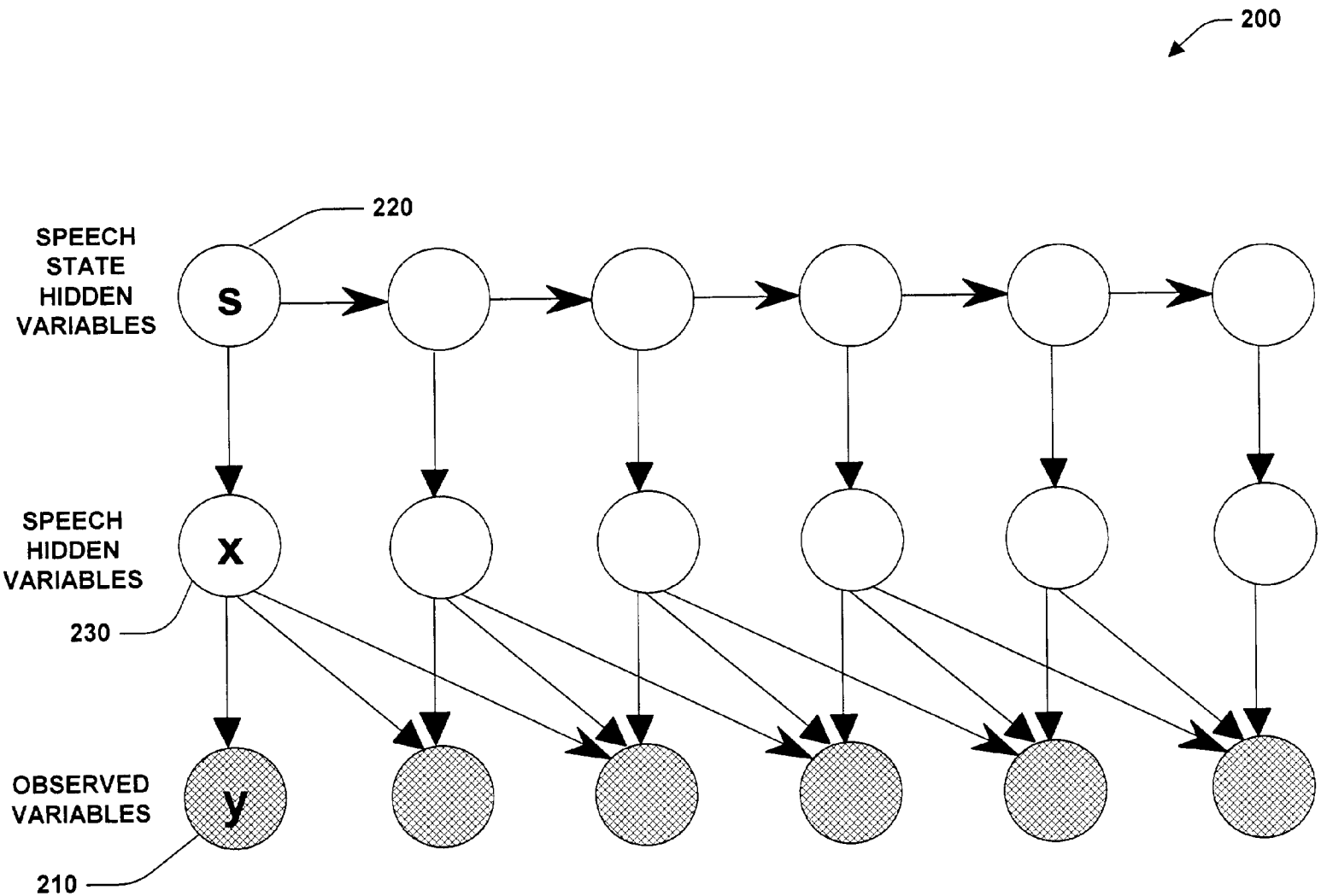
FIG. 2 is a graphical model representation for the signal enhancement adaptive system components in accordance with an aspect of the present invention.

Thus, the system 100 combines the speech model 110 with the noise model 120 to create a overall model for the observed sensor signals. The resulting model is a hidden variable model, where the original speech signal and speech state are the hidden (unobserved) variables, and the sensor signals are the data (observed) variables. Turning briefly to FIG. 2, a graphical model 200 representation of components of the system 100 is illustrated. The graphical model 200 includes observed variables (y) 210, speech state hidden variables (s) 220 and speech hidden variables (x) 230.

Referring back to FIG. 1, the model 100 utilizes the adaptive filter parameters 130 ($H_m^i[k]$) to provide an enhanced signal output (e.g., Bayes optimal estimator of the original speech signal) based on a plurality of frequency transformed input signals. The adaptive filter parameters 130 are modified based, at least in part, upon the speech model 110, the noise model 120 and/or the enhanced signal output.

In one example an EM algorithm is employed to estimate the adaptive filter parameters 130 ($H_m^i[k]$) and/or the noise spectra $B^i[k]$ from the observed sensor data Y. The EM algorithm also computes the required sufficient statistics (SS) and the speech signal estimator $\hat{X}_m[k]$ (e.g., the enhanced signal output).

Each iteration in the EM algorithm consists of an expectation step (or E-step) and a maximization step (or M-step). For each iteration, the algorithm gradually improves the parameterization until convergence. The EM algorithm may be performed as many EM iterations as necessary (e.g., to substantial convergence). For additional details concerning EM algorithms in general, reference may be made to Dempster et al., Maximum Likelihood from Incomplete Data via the EM Algorithm, Journal of the Royal Statistical Society, Series B, 39, 1-38 (1977).

Unfortunately, a straightforward implementation of EM for the system 100 leads to a computationally intractable algorithm. To see this, recall that the central object of the E-step is the conditional distribution over the unobserved variables X, S given the observed ones Y, p(X, S|Y). This distribution, termed the posterior distribution, can in principle be obtained from the complete data distribution of equation (13) via Bayes' rule. It is from the posterior that the SS are derived. The difficulty comes from having to sum over the $C^M$ configurations of component labels $S=(S_0, \ldots, S_{M-1})$, where C is the number of speech model components and M the number of frames. Speech models that lead to good performance include at least 100 components. Whereas for short filters (e.g., relative to the window length N) M=1,2 and exact summation is possible, realistic scenarios have $M \geqq 5$, which require summation over at least $10^{10}$ configurations.

In accordance with an aspect of the present invention, an EM algorithm that uses a systematic approximation to compute the SS is employed with the system 100. The effect of the approximation is to introduce an additional iterative procedure nested within the E-step. This approximation is based on variational techniques. Details of the EM algorithm are set forth infra.

In order to compute the SS, for each frame m and subband k, the E-step computes (1) the conditional mean and precision of $X_m[k]$ given $S_m=s$ and the observed data Y, denoted by $\rho_{sm}[k]$ and $\nu_{sm}[k]$, and (2) the conditional probability that $S_m=s$ given Y, denoted $\gamma_{sm}$:

$$\rho_{sm}[k]=E(X_m[k]|S_m=s,\ Y),$$

$$\nu_{sm}[k]=E(|X_m[k]|^2|S_m=s,\ Y)-|\rho_{sm}[k]|^2,$$

$$\gamma_{sm}=p(S_m=s|Y) \tag{14}$$

where E denotes averaging with respect to $p(X_m[k]|S_m=s,Y)$.

These quantities are computed in the E-step. Using them, the mean of the speech signal $\hat{X}_m$ conditioned on the observed data Y is computed:

$$\hat{X}_m[k] = E(X_m[k] \mid Y) = \sum_s \gamma_{sm}\rho_{sm}[k] \tag{15}$$

which serves as the speech estimator (e.g., enhanced signal output). The autocorrelation of the mean of the speech signal, $\lambda_m[k]$ and its cross correlation with the data $\eta_m[k]$ are also computed:

$$\lambda_m[k] = \sum_n E(X_{n+m}[k]X_n[k]^* \mid Y), \tag{16}$$

$$\lambda_{m>0}[k] = \sum_n \hat{X}_{n+m}[k]\hat{X}_n[k]^*,$$

$$\lambda_{m=0}[k] = \sum_n \gamma_{sn}\left(|\rho_{sn}[k]|^2 + \frac{1}{\nu_{sn}}\right),$$

-continued $$n'_m[k] = \sum_n E\left(Y'_{n+m}[k]X_n[k]^* \mid Y\right) = \sum_n Y'_{n+m}[k]\hat{X}_n[k]^*$$

In the M-step, the following equation is solved:

$$\sum_n H'_n[k]\lambda_{m-n}[k] = \eta'_m[k] \tag{17}$$

for $H_n^i[k]$. This can be done using subband FFT as follows. For each subband k, define the M-point FFT of $H_m^i[k]$ by:

$$\tilde{H}'[k, l] = \sum_{m=0}^{M-1} e^{-i\tilde{\omega}_l m} H'_m[k] \tag{18}$$

where $\tilde{\omega}_l = 2\pi l/M$ are the frequencies, 1=(0:M−1). The subband FFTs $\tilde{\lambda}[k,l]$ and $\tilde{\eta}^i[k,l]$ are defined in the same manner. Thus:

$$\tilde{H}[k, l] = \frac{\tilde{n}[k, l]}{\tilde{\lambda}[k, l]} \tag{19}$$

In the E-step, the means $\rho_{sm}[k]$ (equation (14)) are obtained by solving:

$$\sum_{in} B'[k]H'_{n-m}[k]^*\left(Y'_n[k] - \sum_{r\neq m} H'_{n-r}[k]\hat{X}_r\right) = v_{sm}[k]\rho_{sm}[k] \tag{20}$$

where the variances are given by $$v_{sm}[k] = \sum_{in} B'[k]\left|H'_{n-m}[k]\right|^2 + A_s[k]. \tag{21}$$

The update rule for the probabilities $\gamma_{sm}$ can be expressed in terms of its logarithm:

$$\log\gamma_{sm} = \sum_k \left(v_{sm}[k]\left|\rho_{sm}[k]\right|^2 + \log\frac{A_s[k]}{v_{sm}[k]}\right) + \log\pi_s \tag{22}$$

The E-step equations can be solved iteratively since the $\rho_{sm}$ and the $\gamma_{sm}$ are nonlinearly coupled.

The derivation of the EM variational algorithm starts from defining the functional F:

$$F[q] = \sum_s \int dX\, q(X, S)\left[\log p(Y, X, S) - \log q(X, S)\right] \tag{23}$$

which depends on the distribution of q(X,S) over the hidden variables in the system 100. F also depends on the model parameters. For an arbitrary q, F[q] is bounded from above by the data likelihood:

$$F[q] \leq \log p(Y) \tag{24}$$

An equality is obtained when q is set to the posterior distribution over the hidden variables, q(X,S)=p(X,S|Y).

However, whereas the posterior is in principle computable via Bayes' rule, in practice the required computation is intractable. Instead, we restrict q to a form that factorizes over the frames:

$$q(X, S) = \prod_m q(X_m, S_m) = \prod_m q(X_m \mid S_m)q(S_m), \tag{25}$$

and optimize F with respect to the components $q(X_m|S_m)$, $q(S_m)$. To obtain the first component, the corresponding functional derivative of F is set to zero, $\delta F/\delta q(X_m|S_m=s)=0$, and obtain an expression for log $q(X_m|S_m=s)$. This expression turns out to be quadratic in $X_m$, which implies Gaussianity and results in the following equation:

$$q(X_m \mid S_m = s) = \prod_k N(X_m[k] \mid \rho_{sm}[k], v_{sm}[k]) \tag{26}$$

where the means $\rho_{sm}[k]$ and precisions $v_{sm}[k]$ satisfy equations (20) and (21). To obtain the second component, the corresponding second derivative is set to zero, $\delta F/\delta q(S_m=s)=0$, and an equation for log $q(S_m=s)$ is obtained given equation (22). Recall that $\gamma_{sm}=q(S_m=s)$. This completes the derivation of the E-step.

For the derivation of the M-step, condition F (equation (23)) as a function of the adaptive filter parameters 130. The update rule for a given parameter, for example $A_s[k]$, is derived by setting $\delta F/\delta A_s[k]=0$. The derivative is computed by considering the complete-data likelihood log p(Y,X,S), computing its own derivative, and averaging over X and S with respect to q(X,S) computed in the E-step which results in equation (19).

Since this EM algorithm maximizes a quantity, F, which is bounded from above by the log-likelihood of the data (equation (24)), the EM algorithm is stable.

The algorithm has been tested using 10 sentences from the Wall Street Journal dataset referenced above, working at a 16 kHz sampling rate. Real room, 2000 tap filters, whose impulse responses have been measured separately using a microphone array were used. Noise signals recorded in an office containing a PC and air conditioning were used. For each sentence, two microphone signals were created by convolving it with two different filters and adding two noise signals at 10 dB SNR (relative to the convolved signals). The algorithm was applied to the microphone signals using a random parameter initialization. After estimating the filter and noise parameters and the original speech signal for each sentence, the SNR improvement was computed. Averaging over sentences, an improvement of the SNR to 13.9 dB has been obtained.

While FIG. 1 is a block diagram illustrating components for the signal enhancement adaptive model 100, it is to be appreciated that the signal enhancement adaptive model 100, the speech model 110, the noise model 120 and/or the adaptive filter parameters 130 can be implemented as one or more computer components, as that term is defined herein. Thus, it is to be appreciated that computer executable components operable to implement the signal enhancement adaptive model 100, the speech model 110, the noise model 120 and/or the adaptive filter parameters 130 can be stored on computer readable media including, but not limited to, an ASIC (application specific integrated circuit), CD (compact disc), DVD (digital video disk), ROM (read only memory), floppy disk, hard disk, EEPROM (electrically erasable programmable read only memory) and memory stick in accordance with the present invention.

Figure 3:
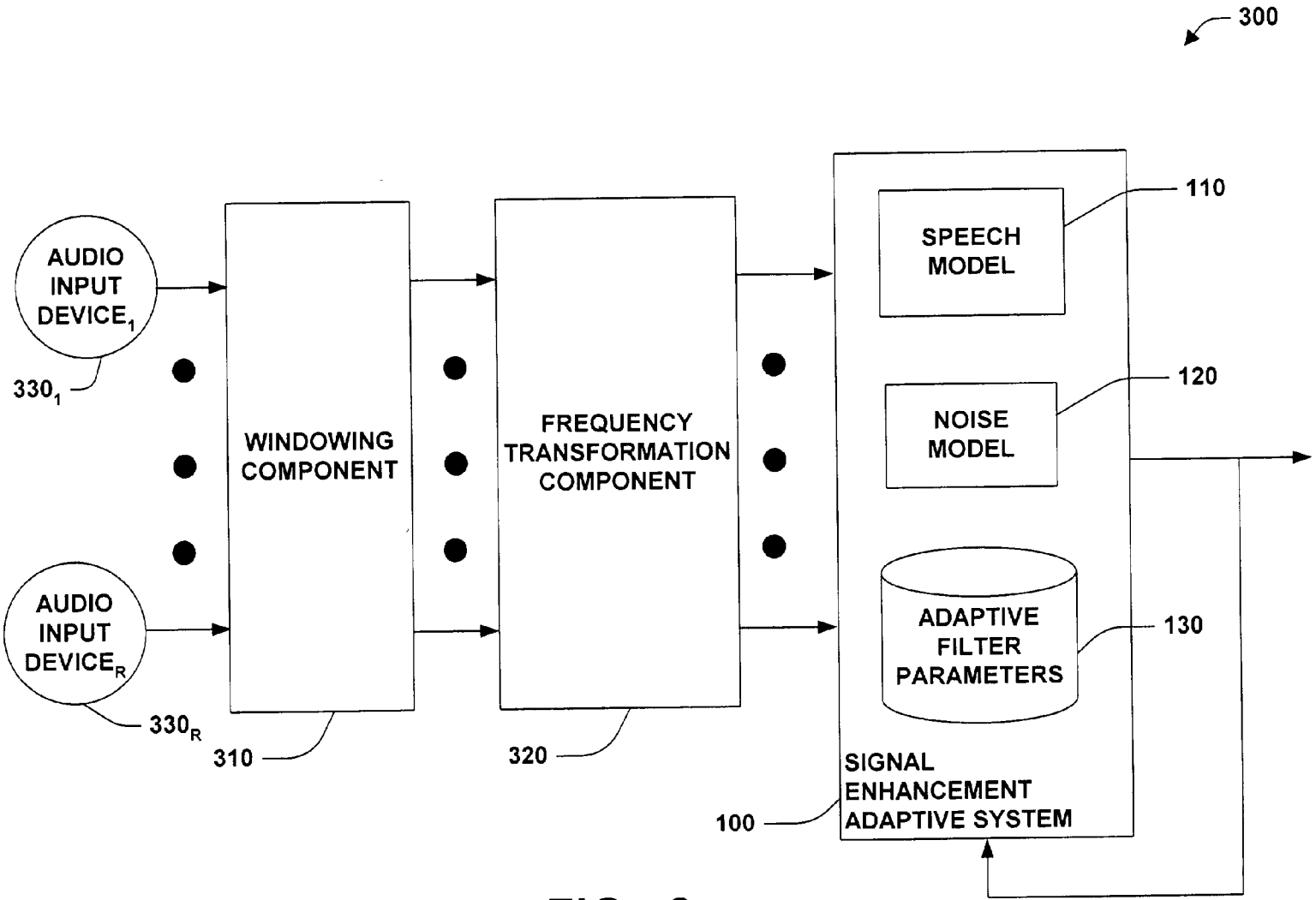
FIG. 3 is a block diagram of an overall signal enhancement system in accordance with an aspect of the present invention.

Turning to FIG. 3, an overall signal enhancement system 300 in accordance with an aspect of the present invention is illustrated. The system 300 includes a signal enhancement adaptive system 100 (e.g., subsystem of the overall system 300), a windowing component 310, a frequency transformation component 320 and/or a first audio input device $\mathbf{330}_1$ through an Rth audio input device $\mathbf{330}_R$, R being an integer greater to or equal to two. The first audio input device $\mathbf{330}_1$ through the Rth audio input device $\mathbf{330}_R$ can be collectively referred to as the audio input devices 330.

The windowing component 310 facilitates obtaining subband signals by applying an N-point window to input signals, for example, received from the audio input devices 330. The windowing component 310 provides a windowed signal output.

The frequency transformation component 320 receives the windowed signal output from the windowing component 310 and computes a frequency transform of the windowed signal. For purposes of discussion with regard to the present invention, a Fast Fourier Transform (FFT) of the windowed signal will be used; however, it is to be appreciated that the frequency transformation component 320 can perform any type of frequency transform suitable for carrying out the present invention can be employed and all such types of frequency transforms are intended to fall within the scope of the hereto appended claims.

The frequency transformation component 320 provides frequency transformed, windowed signals to the signal enhancement adaptive model 100 which provides an enhanced signal output as discussed previously.

Figure 4:
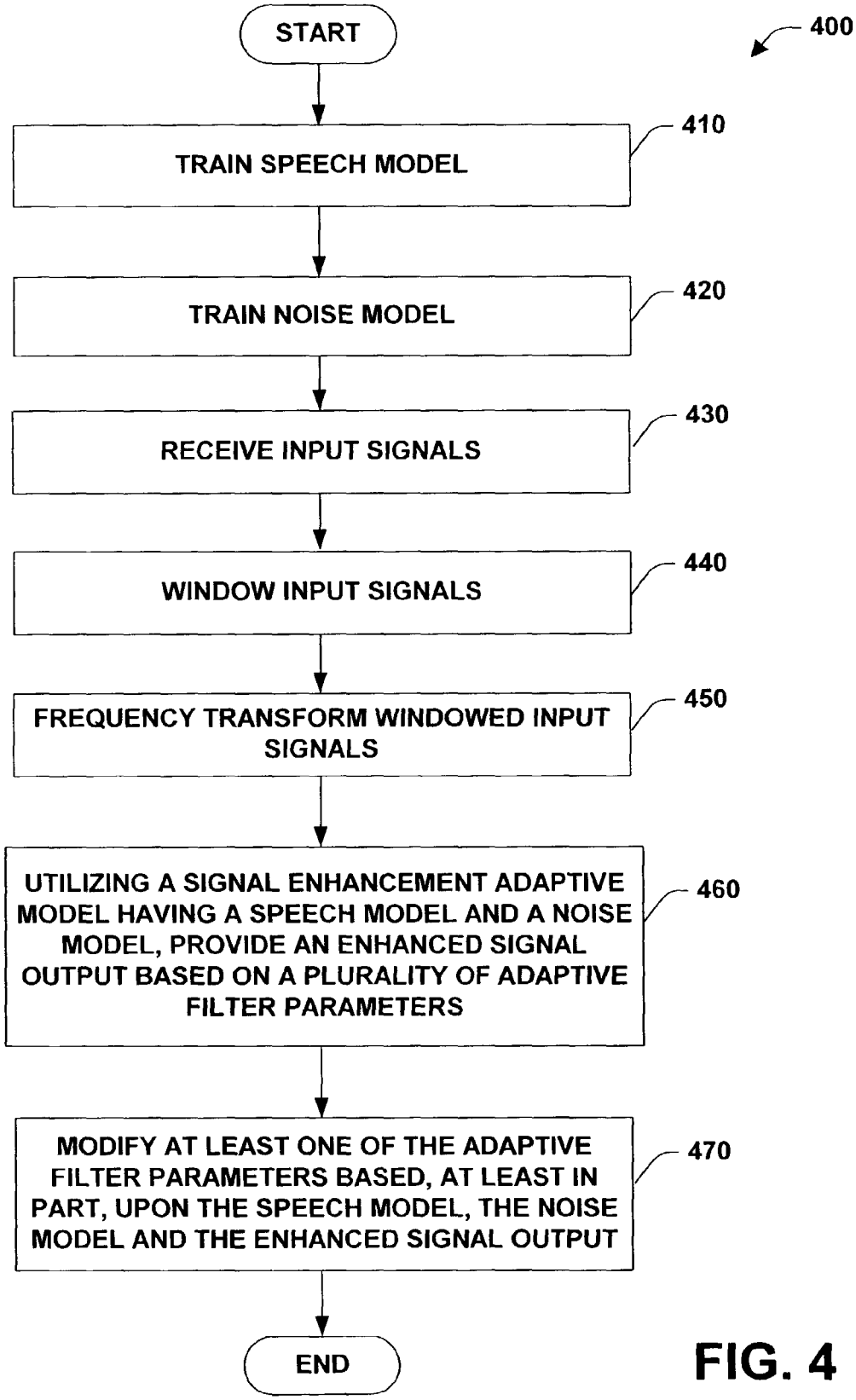
FIG. 4 is a flow chart illustrating a methodology for speech signal enhancement in accordance with an aspect of the present invention.
Figure 5:
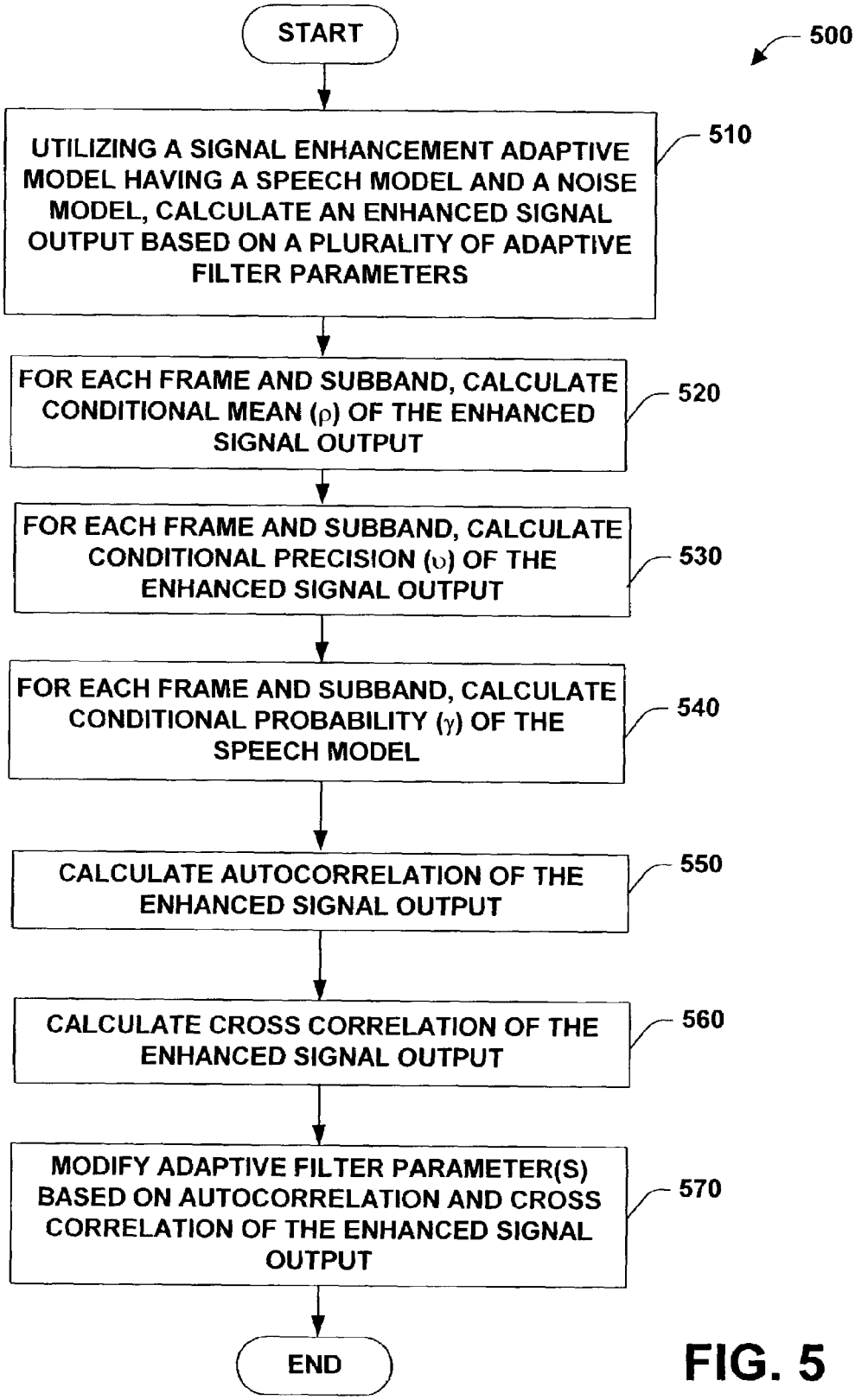
FIG. 5 is a flow chart illustrating another methodology for speech signal enhancement in accordance with an aspect of the present invention.

In view of the exemplary systems shown and described above, methodologies that may be implemented in accordance with the present invention will be better appreciated with reference to the flow charts of FIGS. 4 and 5. While, for purposes of simplicity of explanation, the methodologies are shown and described as a series of blocks, it is to be understood and appreciated that the present invention is not limited by the order of the blocks, as some blocks may, in accordance with the present invention, occur in different orders and/or concurrently with other blocks from that shown and described herein. Moreover, not all illustrated blocks may be required to implement the methodologies in accordance with the present invention.

The invention may be described in the general context of computer-executable instructions, such as program modules, executed by one or more components. Generally, program modules include routines, programs, objects, data structures, etc. that perform particular tasks or implement particular abstract data types. Typically the functionality of the program modules may be combined or distributed as desired in various embodiments.

Turning to FIG. 4, a method 400 for speech signal enhancement in accordance with an aspect of the present invention is illustrated. At 410, a speech model is trained (e.g., speech model 110). At 420, a noise model is trained (e.g., noise model 120).

At 430, a plurality of input signals are received (e.g., by a windowing component 310). At 440, the input signals are windowed (e.g., by the windowing component 310). Next, at 450, the windowed input signals are frequency transformed (e.g., by a frequency transformation component 320).

At 460, utilizing a signal enhancement adaptive system (e.g., subsystem of an overall system) having a speech model and a noise model (e.g., model 100), an enhanced signal output based on a plurality of adaptive filter parameters is provided. At 470, at least one of the plurality of adaptive filter parameters is modified based, at least in part, upon the speech model, the noise model and the enhanced signal output.

Referring to FIG. 5, another (e.g., more detailed) method 500 for speech signal enhancement in accordance with an aspect of the present invention is illustrated. The method 500 employs an expectation maximization variational method at discuss supra. At 510, an enhanced signal output is calculated based on a plurality of adaptive filter parameters (e.g., utilizing a signal enhancement adaptive filter having a speech model and a noise model, for example, the signal enhancement adaptive filter 100). At 520, for each frame and subband, a conditional mean of the enhanced signal output is calculated (e.g., using equation (14)). At 530, for each frame and subband, a conditional precision of the enhanced signal output is calculated (e.g., using equation (14)). At 540, for each frame and subband, a conditional probability of the speech model is calculated (e.g., using equation (14)).

At 550, an autocorrelation of the enhanced signal output is calculated (e.g., using equation (16)). At 560, a cross correlation of the enhanced signal output is calculated (e.g., using equation (16)). At 570, at least one of the adaptive filter parameters is modified based on the autocorrelation and cross correlation of the enhanced signal output (e.g., using equations 17, 18 and 19).

It is to be appreciated that the system and/or method of the present invention can be utilized in an overall signal enhancement system. Further, those skilled in the art will recognize that the system and/or method of the present invention can be employed in a vast array of acoustic applications, including, but not limited to, teleconferencing and/or speech recognition.

Figure 6:
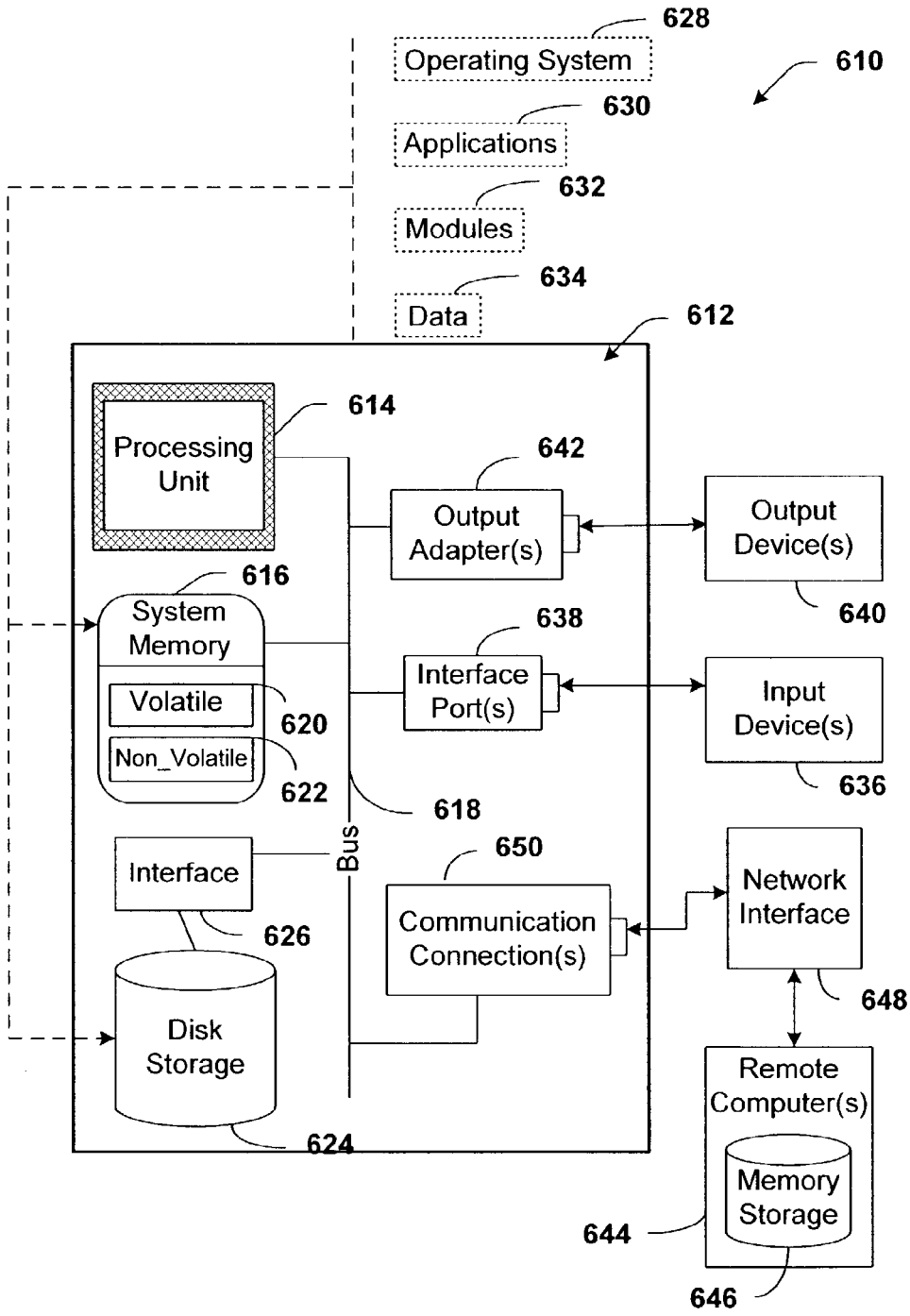
FIG. 6 illustrates an example operating environment in which the present invention may function.

In order to provide additional context for various aspects of the present invention, FIG. 6 and the following discussion are intended to provide a brief, general description of a suitable operating environment 610 in which various aspects of the present invention may be implemented. While the invention is described in the general context of computer-executable instructions, such as program modules, executed by one or more computers or other devices, those skilled in the art will recognize that the invention can also be implemented in combination with other program modules and/or as a combination of hardware and software. Generally, however, program modules include routines, programs, objects, components, data structures, etc. that perform particular tasks or implement particular data types. The operating environment 610 is only one example of a suitable operating environment and is not intended to suggest any limitation as to the scope of use or functionality of the invention. Other well known computer systems, environments, and/or configurations that may be suitable for use with the invention include but are not limited to, personal computers, hand-held or laptop devices, multiprocessor systems, microprocessor-based systems, programmable consumer electronics, network PCs, minicomputers, mainframe computers, distributed computing environments that include the above systems or devices, and the like.

With reference to FIG. 6, an exemplary environment 610 for implementing various aspects of the invention includes a computer 612. The computer 612 includes a processing unit 614, a system memory 616, and a system bus 618. The system bus 618 couples system components including, but not limited to, the system memory 616 to the processing unit 614. The processing unit 614 can be any of various available processors. Dual microprocessors and other multiprocessor architectures also can be employed as the processing unit 614.

The system bus 618 can be any of several types of bus structure(s) including the memory bus or memory controller, a peripheral bus or external bus, and/or a local bus using any variety of available bus architectures including, but not limited to, 6-bit bus, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI).

The system memory 616 includes volatile memory 620 and nonvolatile memory 622. The basic input/output system (BIOS), containing the basic routines to transfer information between elements within the computer 612, such as during start-up, is stored in nonvolatile memory 622. By way of illustration, and not limitation, nonvolatile memory 622 can include read only memory (ROM), programmable ROM (PROM), electrically programmable ROM (EPROM), electrically erasable ROM (EEPROM), or flash memory. Volatile memory 620 includes random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM).

Computer 612 also includes removable/nonremovable, volatile/nonvolatile computer storage media. FIG. 6 illustrates, for example a disk storage 624. Disk storage 624 includes, but is not limited to, devices like a magnetic disk drive, floppy disk drive, tape drive, Jaz drive, Zip drive, LS-100 drive, flash memory card, or memory stick. In addition, disk storage 624 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 624 to the system bus 618, a removable or non-removable interface is typically used such as interface 626.

It is to be appreciated that FIG. 6 describes software that acts as an intermediary between users and the basic computer resources described in suitable operating environment 610. Such software includes an operating system 628. Operating system 628, which can be stored on disk storage 624, acts to control and allocate resources of the computer system 612. System applications 630 take advantage of the management of resources by operating system 628 through program modules 632 and program data 634 stored either in system memory 616 or on disk storage 624. It is to be appreciated that the present invention can be implemented with various operating systems or combinations of operating systems.

A user enters commands or information into the computer 612 through input device(s) 636. Input devices 636 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 614 through the system bus 618 via interface port(s) 638. Interface port(s) 638 include, for example, a serial port, a parallel port, a game port, and a universal serial bus (USB). Output device(s) 640 use some of the same type of ports as input device(s) 636. Thus, for example, a USB port may be used to provide input to computer 612, and to output information from computer 612 to an output device 640. Output adapter 642 is provided to illustrate that there are some output devices 640 like monitors, speakers, and printers among other output devices 640 that require special adapters. The output adapters 642 include, by way of illustration and not limitation, video and sound cards that provide a means of connection between the output device 640 and the system bus 618. It should be noted that other devices and/or systems of devices provide both input and output capabilities such as remote computer(s) 644.

Computer 612 can operate in a networked environment using logical connections to one or more remote computers, such as remote computer(s) 644. The remote computer(s) 644 can be a personal computer, a server, a router, a network PC, a workstation, a microprocessor based appliance, a peer device or other common network node and the like, and typically includes many or all of the elements described relative to computer 612. For purposes of brevity, only a memory storage device 646 is illustrated with remote computer(s) 644. Remote computer(s) 644 is logically connected to computer 612 through a network interface 648 and then physically connected via communication connection 650. Network interface 648 encompasses communication networks such as local-area networks (LAN) and wide-area networks (WAN). LAN technologies include Fiber Distributed Data Interface (FDDI), Copper Distributed Data Interface (CDDI), Ethernet/IEEE 602.3, Token Ring/IEEE 602.5 and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 650 refers to the hardware/software employed to connect the network interface 648 to the bus 618. While communication connection 650 is shown for illustrative clarity inside computer 612, it can also be external to computer 612. The hardware/software necessary for connection to the network interface 648 includes, for exemplary purposes only, internal and external technologies such as, modems including regular telephone grade modems, cable modems and DSL modems, ISDN adapters, and Ethernet cards.

What has been described above includes examples of the present invention. It is, of course, not possible to describe every conceivable combination of components or methodologies for purposes of describing the present invention, but one of ordinary skill in the art may recognize that many further combinations and permutations of the present invention are possible. Accordingly, the present invention is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A computer implemented signal enhancement system, comprising the following computer executable components:

a speech model that characterizes statistical properties of speech;

a noise model that characterizes statistical properties of noise;

a windowed component that applies an N-point window to input signals;

a frequency transformation component that receives a windowed signal output from the windowed component and computes a frequency transform of the windowed signal to generate a plurality of frequency transformed input signals; and a plurality of adaptive filter parameters utilized by the signal enhancement adaptive system to provide an enhanced signal output, the enhanced signal output being based, at least in part, upon the plurality of frequency transformed input signals, the plurality of adaptive filter parameters being modified based, at least in part, upon the speech model, the noise model and the enhanced signal output.

2. The signal enhancement system of claim 1, the speech model employing, at least in part, the equations:

$$p(X \mid S) = \prod_m p(X_m \mid S_m),\ p(S) = \prod_m p(S_m)$$

where S are speech components of the speech model,

X are speech signals corresponding to the speech components, $X_m$ is a subband signal of the enhanced signal output at frame m, and, $S_m$ is a component of the speech model at frame m.

3. The signal enhancement system of claim 1, the noise model employing, at least in part, the equation:

$$p(Y_m^i \mid X) = \prod_k \mathcal{N}\left(Y_m^i[k] \,\middle|\, \sum_n H_n^i[k] X_{m-n}[k],\ B^i[k]\right)$$

wherein $Y_m^i$ is one of the frequency transformed input signals at frame m,

X are speech signals corresponding to speech components, $Y_m^i[k]$ is a subband of one of the frequency transformed input signals at frame m, $H_n^i[k]$ is one of the plurality of adaptive filter parameters;

$X_{m-n}[k]$ is a subband of a time delay of speech signals corresponding to speech components; and, $B^i[k]$ is the noise model.

4. The signal enhancement system of claim 1, modification of at least one of the plurality of adaptive filter parameters being based upon a variational method.

5. The signal enhancement system of claim 1, modification of at least one of the plurality of adaptive filter parameters being based, at least in part, upon the equation:

$$v_{sm}[k] = \sum_m B^i[k] \left| H_{n-m}^i[k] \right|^2 + A_s[k]$$

wherein $v_{sm}[k]$ is the precision of $X_m[k]$, wherein $X_m[k]$ is the enhanced signal output, $B^i[k]$ is the noise model, $H_{n-m}^i[k]$ is one of the plurality of adaptive filter parameters; and, $A_s[k]$ is the precision of a component s of the speech model.

6. The signal enhancement system of claim 1, modification of at least one of the plurality of adaptive filter parameters being based upon a variational expectation maximization algorithm having an expectation step (E-step) and an maximization step (M-step).

7. The signal enhancement system of claim 6, the E-step being based, at least in part, upon the equations:

$$H_{n-m}^i[k]$$

wherein $v_{sm}[k]$ is the precision of the enhanced signal output, $\rho_{sm}[k]$ is the mean of the enhanced signal output, $B^i[k]$ is the noise model, $Y_m^i[k]$ is a subband of one of the frequency transformed input signals at frame m, $H_{n-m}^i[k]$ is one of the plurality of adaptive filter parameters $\hat{X}_r$ is the enhanced signal output; and, $A_s[k]$ is the precision of a component s of the speech model.

8. The signal enhancement system of claim 1, the noise model being trained on a large dataset of clean speech, at least in part, off-line.

9. The signal enhancement system of claim 1, the noise model being trained on a large dataset of clean speech, at least in part, during a quiet period of at least one of the plurality of frequency transformed input signals.

10. The signal enhancement system of claim 1, the noise model being trained on a large dataset of clean speech, at least in part, during operation of the signal enhancement adaptive model.

11. A computer implemented signal enhancement system, comprising the following computer executable components:

a frequency transformation component that receives windowed signal inputs, computes a frequency transform of the windowed signals, and provides outputs of frequency transformed windowed signals; and, a signal enhancement adaptive system that receives the frequency transformed windowed signals from the frequency transformation component and provides an enhanced signal output, the enhanced signal output being based, at least in part, upon the frequency transformed windowed signals;

wherein the signal enhancement adaptive system has a speech model, a noise model and a plurality of adaptive filter parameters also utilized to provide an enhanced signal output, the plurality of adaptive filter parameters being modified based, at least in part, upon the speech model, the noise model and the enhanced signal output.

12. The system of claim 11, further comprising a windowing component that applies an N-point window to input signals and provides the windowed signal inputs to the frequency transformation component.

13. The system of claim 11, further comprising at least two audio input devices that provide the input signals.

14. The system of claim 13, at least one of the two audio input devices being a microphone.

15. The system of claim 11, the frequency transform being a Fast Fourier Transform.

16. A computer implemented method for speech signal enhancement, comprising the following computer executable acts:

receiving input signals;

windowing the input signals;

performing a frequency transform of the windowed input signals to generate a plurality of frequency transformed input signals;

utilizing a signal enhancement adaptive model having a speech model and a noise model;

providing a plurality of adaptive filter parameters utilized to provide an enhanced signal output, the enhanced signal output based on the plurality of the frequency transformed input signals; and modifying at least one of the adaptive filter parameters based, at least in part, upon the speech model, the noise model and the enhanced signal output.

17. The method of claim 16, further comprising at least one of the following acts:

training the speech model on a large dataset of clean speech, training the noise model offline from quiet moments in a noisy signal and online using expectation maximization on a full microphone signal.

18. A computer implemented method for speech signal enhancement, comprising the following computer executable acts:

calculating an enhanced signal output based on a plurality of adaptive filter parameters;

for each frame and subband, calculating a conditional mean of the enhanced signal output;

for each frame and subband, calculating a conditional precision of the enhanced signal output;

for each frame and subband, calculating a conditional probability of a speech model;

calculating an autocorrelation of the enhanced signal output;

calculating a cross correlation of the enhanced signal output; and, modifying at least one of the plurality of adaptive filter parameters based on the autocorrelation and cross correlation of the enhanced signal output.

19. A computer readable medium having stored thereon a data structure, comprising:

a first data field comprising a speech model that characterizes statistical properties of speech;

a second data field comprising a noise model that characterizes statistical properties of noise;

a third data field comprising a windowed component that applies an N-point window to input signals;

a fourth data field comprising a frequency transformation component that receives a windowed signal output from the windowed component and computes a frequency transform of the windowed signal to generate a plurality of frequency transformed input signals;

a fifth data field comprising an enhanced signal output being based, at least in part, upon the plurality of frequency transformed input signals; and a sixth data field comprising a plurality of adaptive filter parameters, at least one of the plurality of adaptive filter parameters having been modified based, at least in part, upon the enhanced signal output, the speech model and the noise model.

20. A computer readable medium storing computer executable components of a signal enhancement model, comprising:

a speech model component that models speech;

a noise model component that models noise;

a windowed component that applies an N-point window to input signals; and a frequency transformation component that receives a windowed signal output from the windowed component and computes a frequency transform of the windowed signal to generate a plurality of frequency transformed input signals;

the signal enhancement model utilizing a plurality of adaptive filter parameters to provide an enhanced signal output, the enhanced signal output being based, at least in part upon, the plurality of frequency transformed input signals, the plurality of adaptive filter parameters being modified based, at least in part, upon the speech model, the noise model and the enhanced signal output.

21. A computer implemented signal enhancement system, comprising:

computer implemented means for windowing a plurality of input signals;

computer implemented means for frequency transforming the plurality of windowed input signals;

computer implemented means for receiving the frequency transformed windowed signals;

computer implemented means for providing an enhanced signal output based, at least in part, upon the frequency transformed windowed signals;

computer implemented means for modeling speech;

computer implemented means for modeling noise;

computer implemented means for providing a plurality of adaptive filter parameters; and, computer implemented means for modifying the plurality of adaptive filter parameters, the modification being based, at least in part, upon the means for modeling speech, the means for modeling noise and the enhanced signal output.

* * * * *